US010155207B2

(12) United States Patent
Yurkovetsky et al.

(10) Patent No.: US 10,155,207 B2
(45) **Date of Patent: *Dec. 18, 2018**

(54) METHODS FOR FORMING MIXED DROPLETS

(71) Applicant: Bio-Rad Laboratories, Inc., Hercules, CA (US)

(72) Inventors: Yevgeny Yurkovetsky, Winchester, MA (US); Darren R. Link, Lexington, MA (US); Jonathan William Larson, Chelsea, MA (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/171,616

(22) Filed: Jun. 2, 2016

(65) Prior Publication Data

US 2016/0346748 A1 Dec. 1, 2016

Related U.S. Application Data

(63) Continuation of application No. 13/371,222, filed on Feb. 10, 2012, now Pat. No. 9,364,803.

(60) Provisional application No. 61/441,985, filed on Feb. 11, 2011.

(51) Int. Cl.

| | |
|---|---|
| ***B01L 3/00*** | (2006.01) |
| ***B01F 13/00*** | (2006.01) |
| ***B01F 5/04*** | (2006.01) |
| ***B01L 7/00*** | (2006.01) |
| ***B01F 3/08*** | (2006.01) |
| ***B01F 5/00*** | (2006.01) |

(52) U.S. Cl.

CPC ..... *B01F 13/0076* (2013.01); *B01F 3/0803* (2013.01); *B01F 3/0865* (2013.01); *B01F 5/0085* (2013.01); *B01F 5/0471* (2013.01); *B01F 5/0473* (2013.01); *B01F 13/0062* (2013.01); *B01F 13/0071* (2013.01); *B01L 3/502784* (2013.01); *B01L 7/525* (2013.01); *B01F 2215/0037* (2013.01); *B01L 2200/0652* (2013.01); *B01L 2200/0673* (2013.01); *B01L 2300/0867* (2013.01); *B01L 2400/0415* (2013.01); *B01L 2400/0487* (2013.01)

(58) Field of Classification Search

None

See application file for complete search history.

(56) References Cited

U.S. PATENT DOCUMENTS

| | | | | |
|---|---|---|---|---|
| 9,364,803 | B2 * | 6/2016 | Yurkovetsky | B01F 5/0471 |
| 2002/0058332 | A1 * | 5/2002 | Quake | B01L 3/502761 435/288.5 |
| 2006/0163385 | A1 * | 7/2006 | Link | B01F 5/0682 239/424 |

FOREIGN PATENT DOCUMENTS

| | | | |
|---|---|---|---|
| WO | WO 2010/151776 | * 12/2010 | G01N 35/10 |

* cited by examiner

*Primary Examiner* — Betty J Forman

(74) *Attorney, Agent, or Firm* — Brown Rudnick LLP; Thomas C. Meyers

(57) ABSTRACT

The invention generally relates to methods for forming mixed droplets. In certain embodiments, methods of the invention involve forming a droplet, and contacting the droplet with a fluid stream, wherein a portion of the fluid stream integrates with the droplet to form a mixed droplet.

18 Claims, 11 Drawing Sheets

METHODS FOR FORMING MIXED DROPLETS

RELATED APPLICATION

The present application is a continuation of U.S. Non-Provisional Ser. No. 13/371,222, filed Feb. 10, 2012, which claims the benefit of and priority to U.S. Provisional No. 61/441,985, filed Feb. 11, 2011, the contents of which are incorporated by reference herein in their entireties.

FIELD OF THE INVENTION

The invention generally relates to methods for forming mixed droplets.

BACKGROUND

Microfluidics involves micro-scale devices that handle small volumes of fluids. Because microfluidics can accurately and reproducibly control and dispense small fluid volumes, in particular volumes less than 1 μl, application of microfluidics provides significant cost-savings. The use of microfluidics technology reduces cycle times, shortens time-to-results, and increases throughput. Furthermore, incorporation of microfluidics technology enhances system integration and automation.

Microfluidic reactions are generally conducted in microdroplets. The ability to conduct reactions in microdroplets depends on being able to merge different sample fluids and different microdroplets. A controlled modification of a chemical composition of the microdroplets is of crucial importance to the success of biochemical assays. Generally, conducting reactions in microdroplets involves merging a pair of pre-made microdroplets of different compositions, resulting in the formation of a mixed droplet that carries a mix of components needed for a particular assay. For example, in the context of PCR, a first droplet carries sample nucleic acid and a second droplet carries reagents necessary for conducting the PCR reaction (e.g., polymerase enzyme, forward and reverse primers, dNTPs buffer, and salts). Merging of the droplets produces a mixed droplet containing sample nucleic acid and PCR reagents so that the PCR reaction may be conducted in the microdroplet.

This mixing approach requires pre-emulsification of two liquid phases and a subsequent careful matching of pairs of the two different types of droplets for the purpose of achieving an optimal merge ratio of 1:1, which leads to sub-optimally merged droplets, and thus sub-optimal reactions or assays.

SUMMARY

Methods of the invention provide an approach to merging two liquid dispersed phases in which only one phase needs to reach a merge area in a form of a droplet. The other phase is injected into these drops directly from a continuous stream. In this manner, methods of the invention provide a simplified and more reliable approach to sample fluid mixing because only one of the two phases is dispersed as a droplet prior to its merge with the other phase.

In certain aspects, methods of the invention involve forming a sample droplet. Any technique known in the art for forming sample droplets may be used with methods of the invention. An exemplary method involves flowing a stream of sample fluid such that it intersects two opposing streams of flowing carrier fluid. The carrier fluid is immiscible with the sample fluid. Intersection of the sample fluid with the two opposing streams of flowing carrier fluid results in partitioning of the sample fluid into individual sample droplets. The carrier fluid may be any fluid that is immiscible with the sample fluid. An exemplary carrier fluid is oil. In certain embodiments, the carrier fluid includes a surfactant, such as a fluorosurfactant.

Methods of the invention further involve contacting the droplet with a fluid stream. Contact between the two droplet and the fluid stream results in a portion of the fluid stream integrating with the droplet to form a mixed droplet.

Methods of the invention may be conducted in microfluidic channels. As such, in certain embodiments, methods of the invention may further involve flowing the droplet through a first channel and flowing the fluid stream through a second channel. The first and second channels are oriented such that the channels intersect each other. Any angle that results in an intersection of the channels may be used. In a particular embodiment, the first and second channels are oriented perpendicular to each other.

Methods of the invention may further involve applying an electric field to the droplet and the fluid stream. The electric field assists in rupturing the interface separating the two sample fluids. In particular embodiments, the electric field is a high-frequency electric field.

In another aspect, methods of the invention involve forming a droplet surrounded by an immiscible carrier fluid, flowing the droplet through a first channel, contacting the droplet with a fluid stream in the presence of an electric field, in which contact between the droplet and the fluid stream in the presence of an electric field results in a portion of the fluid stream integrating with the droplet to form a mixed droplet.

BRIEF DESCRIPTION OF THE DRAWINGS

FIG. 3A shows a non-perpendicular orientation of the two channels at the merge site. FIGS. 3B-E shows a perpendicular orientation of the two channels at the merge site.

FIG. 4 also shows that an insulating layer may optionally be placed between the channels and the electrodes.

FIG. 7A is with electrodes and FIG. 7B is without electrodes.

FIG. 9 shows an embodiment that employs an electric field to facilitate droplet merging.

FIG. 12A shows the droplet approaching the growing bolus of the second fluid stream. FIG. 12B shows the droplet merging and mixing with the bolus of the second fluid stream.

DETAILED DESCRIPTION

The invention generally relates to methods for forming mixed droplets. In certain embodiments, methods of the invention involve forming a droplet, and contacting the droplet with a fluid stream, such that a portion of the fluid stream integrates with the droplet to form a mixed droplet.

Sample droplets may be formed by any method known in the art. The sample droplet may contain any molecule for a biological assay or any molecule for a chemical reaction. The type of molecule in the sample droplet is not important and the invention is not limited to any particular type of sample molecules. In certain embodiments, the sample droplet contains nucleic acid molecules. In certain embodiments, droplets are formed such that the droplets contain, on average, a single target nucleic acid. The droplets are aqueous droplets that are surrounded by an immiscible carrier fluid. Methods of forming such droplets are shown for example in Link et al. (U.S. patent application numbers 2008/0014589, 2008/0003142, and 2010/0137163), Stone et al. (U.S. Pat. No. 7,708,949 and U.S. patent application number 2010/0172803), Anderson et al. (U.S. Pat. No. 7,041,481 and which reissued as RE41,780) and European publication number EP2047910 to Raindance Technologies Inc. The content of each of which is incorporated by reference herein in its entirety.

Figure 1A:
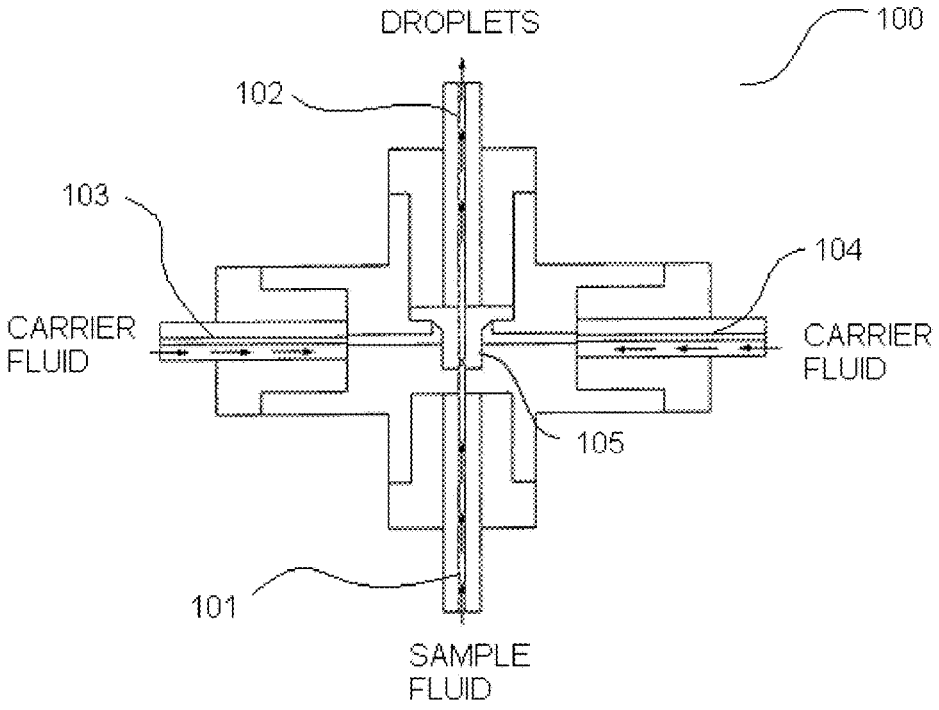
FIGS. 1A-B shows an exemplary embodiment of a device for droplet formation.
Figure 1B:
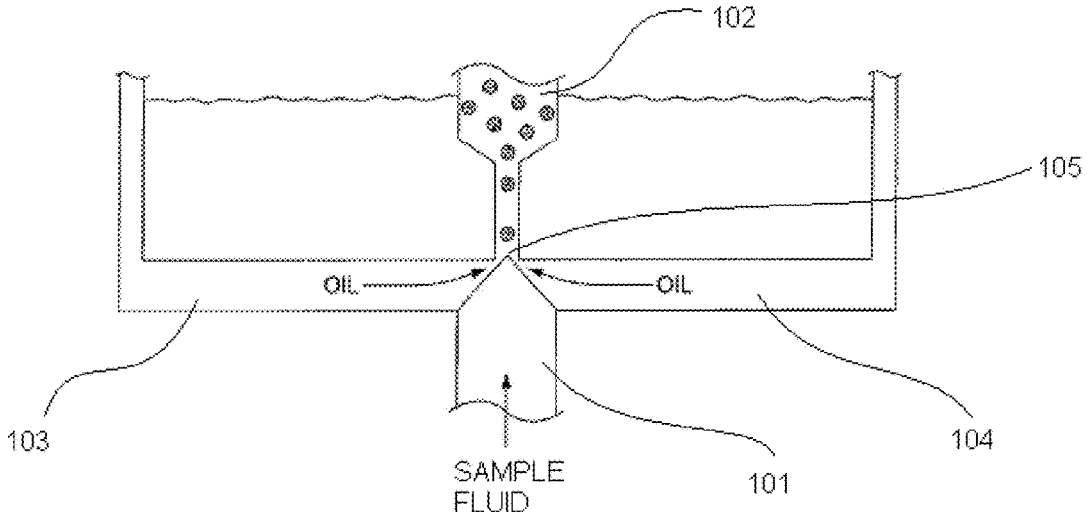

FIGS. 1A-B show an exemplary embodiment of a device 100 for droplet formation. Device 100 includes an inlet channel 101, and outlet channel 102, and two carrier fluid channels 103 and 104. Channels 101, 102, 103, and 104 meet at a junction 105. Inlet channel 101 flows sample fluid to the junction 105. Carrier fluid channels 103 and 104 flow a carrier fluid that is immiscible with the sample fluid to the junction 105. Inlet channel 101 narrows at its distal portion wherein it connects to junction 105 (See FIG. 1B). Inlet channel 101 is oriented to be perpendicular to carrier fluid channels 103 and 104. Droplets are formed as sample fluid flows from inlet channel 101 to junction 105, where the sample fluid interacts with flowing carrier fluid provided to the junction 105 by carrier fluid channels 103 and 104. Outlet channel 102 receives the droplets of sample fluid surrounded by carrier fluid.

The sample fluid is typically an aqueous buffer solution, such as ultrapure water (e.g., 18 mega-ohm resistivity, obtained, for example by column chromatography), 10 mM Tris HCl and 1 mM EDTA (TE) buffer, phosphate buffer saline (PBS) or acetate buffer. Any liquid or buffer that is physiologically compatible with nucleic acid molecules can be used. The carrier fluid is one that is immiscible with the sample fluid. The carrier fluid can be a non-polar solvent, decane (e g., tetradecane or hexadecane), fluorocarbon oil, silicone oil or another oil (for example, mineral oil).

In certain embodiments, the carrier fluid contains one or more additives, such as agents which reduce surface tensions (surfactants). Surfactants can include Tween, Span, fluorosurfactants, and other agents that are soluble in oil relative to water. In some applications, performance is improved by adding a second surfactant to the sample fluid. Surfactants can aid in controlling or optimizing droplet size, flow and uniformity, for example by reducing the shear force needed to extrude or inject droplets into an intersecting channel. This can affect droplet volume and periodicity, or the rate or frequency at which droplets break off into an intersecting channel. Furthermore, the surfactant can serve to stabilize aqueous emulsions in fluorinated oils from coalescing.

In certain embodiments, the droplets may be coated with a surfactant. Preferred surfactants that may be added to the carrier fluid include, but are not limited to, surfactants such as sorbitan-based carboxylic acid esters (e.g., the "Span" surfactants, Fluka Chemika), including sorbitan monolaurate (Span 20), sorbitan monopalmitate (Span 40), sorbitan monostearate (Span 60) and sorbitan monooleate (Span 80), and perfluorinated polyethers (e.g., DuPont Krytox 157 FSL, FSM, and/or FSH). Other non-limiting examples of non-ionic surfactants which may be used include polyoxyethylenated alkylphenols (for example, nonyl-, p-dodecyl-, and dinonylphenols), polyoxyethylenated straight chain alcohols, polyoxyethylenated polyoxypropylene glycols, polyoxyethylenated mercaptans, long chain carboxylic acid esters (for example, glyceryl and polyglyceryl esters of natural fatty acids, propylene glycol, sorbitol, polyoxyethylenated sorbitol esters, polyoxyethylene glycol esters, etc.) and alkanolamines (e.g., diethanolamine-fatty acid condensates and isopropanolamine-fatty acid condensates).

In certain embodiments, the carrier fluid may be caused to flow through the outlet channel so that the surfactant in the carrier fluid coats the channel walls. In one embodiment, the fluorosurfactant can be prepared by reacting the perflourinated polyether DuPont Krytox 157 FSL, FSM, or FSH with aqueous ammonium hydroxide in a volatile fluorinated solvent. The solvent and residual water and ammonia can be removed with a rotary evaporator. The surfactant can then be dissolved (e.g., 2.5 wt %) in a fluorinated oil (e.g., Flourinert (3M)), which then serves as the carrier fluid.

After formation of the sample droplet from the first sample fluid, the droplet is contacted with a flow of a second sample fluid stream. Contact between the droplet and the fluid stream results in a portion of the fluid stream integrating with the droplet to form a mixed droplet.

Figure 2A:
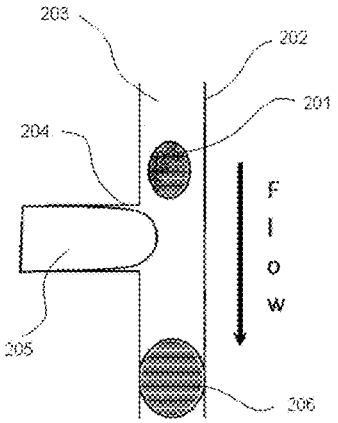
FIGS. 2A-C shows an exemplary embodiment of merging two sample fluids according to methods of the invention.
Figure 2B:
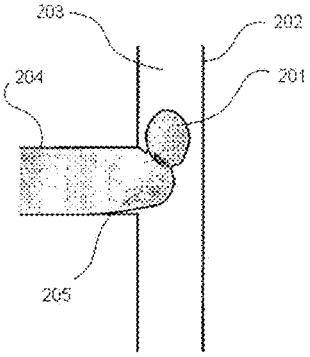
Figure 2C:
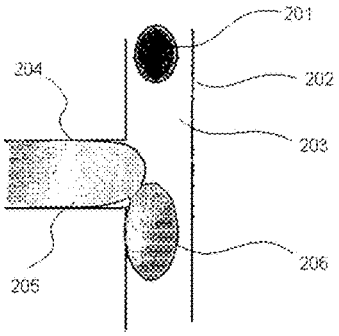
Figure 3A:
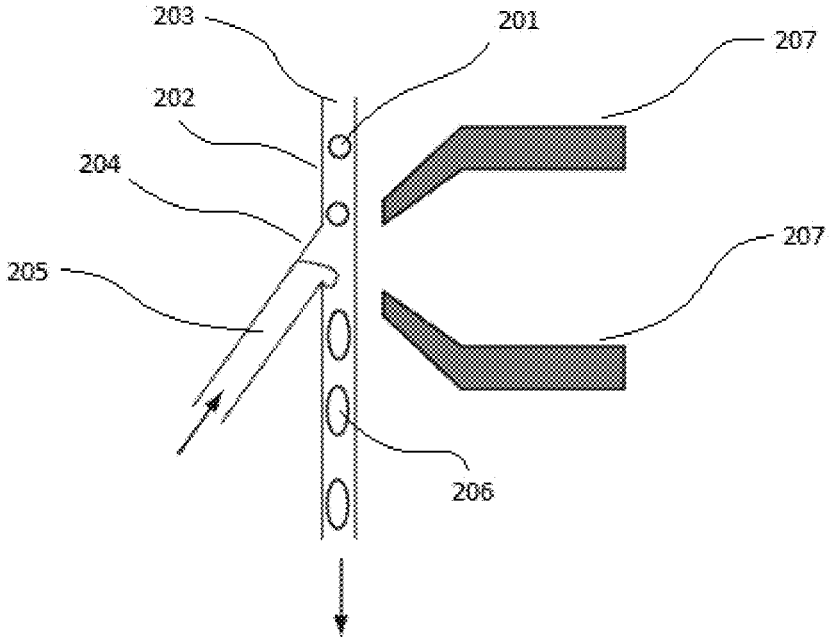
FIGS. 3A-E show embodiments in which electrodes are used with methods of the invention to facilitate droplet merging. These figures show different positioning and different numbers of electrodes that may be used with methods of the invention.

FIGS. 2A-C provide a schematic showing merging of sample fluids according to methods of the invention. Droplets 201 of the first sample fluid flow through a first channel 202 separated from each other by immiscible carrier fluid and suspended in the immiscible carrier fluid 203. The droplets 201 are delivered to the merge area, i.e., junction of the first channel 202 with the second channel 204, by a pressure-driven flow generated by a positive displacement pump. While droplet 201 arrives at the merge area, a bolus of a second sample fluid 205 is protruding from an opening of the second channel 204 into the first channel 202 (FIG. 2A). FIGS. 2A-C and 3B show the intersection of channels 202 and 204 as being perpendicular. However, any angle that results in an intersection of the channels 202 and 204 may be used, and methods of the invention are not limited to the orientation of the channels 202 and 204 shown in FIGS. 2A-C. For example, FIG. 3A shows an embodiment in which channels 202 and 204 are not perpendicular to each other. The droplets 201 shown in FIGS. 2A-C are monodispersive, but non-monodispersive drops are useful in the context of the invention as well.

Figure 12A:
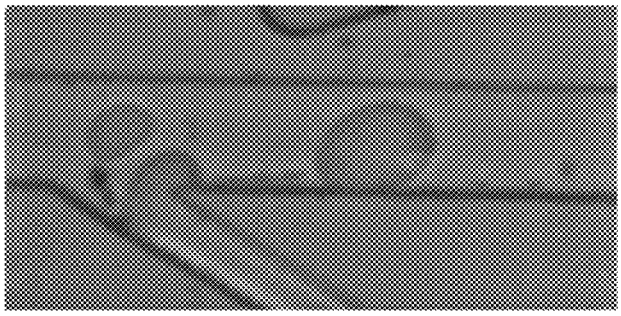
FIGS. 12A-B show a set of photographs showing an arrangement that was employed to form a mixed droplet in which a droplet of a first fluid was brought into contact with a bolus of a second sample fluid stream, in which the bolus was segmented from the second fluid stream and merged with the droplet to form a mixed droplet in an immiscible carrier fluid.
Figure 12B:
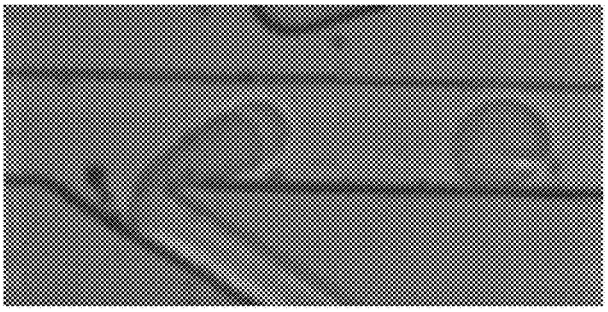

The bolus of the second sample fluid stream 205 continues to increase in size due to pumping action of a positive displacement pump connected to channel 204, which outputs a steady stream of the second sample fluid 205 into the merge area. The flowing droplet 201 containing the first sample fluid eventually contacts the bolus of the second sample fluid 205 that is protruding into the first channel 202. Contact between the two sample fluids results in a portion of the second sample fluid 205 being segmented from the second sample fluid stream and joining with the first sample fluid droplet 201 to form a mixed droplet 206 (FIGS. 2B-C). FIG. 12 shows an arrangement that was employed to form a mixed droplet in which a droplet of a first fluid was brought into contact with a bolus of a second sample fluid stream, in which the bolus was segmented from the second fluid stream and merged with the droplet to form a mixed droplet in an immiscible carrier fluid. FIG. 12A shows the droplet approaching the growing bolus of the second fluid stream. FIG. 12B shows the droplet merging and mixing with the bolus of the second fluid stream. In certain embodiments, each incoming droplet 201 of first sample fluid is merged with the same amount of second sample fluid 205.

In order to achieve the merge of the first and second sample fluids, the interface separating the fluids must be ruptured. In certain embodiments, this rupture can be achieved through the application of an electric charge. In certain embodiments, the rupture will result from application of an electric field. In certain embodiments, the rupture will be achieved through non-electrical means, e.g. by hydrophobic/hydrophilic patterning of the surface contacting the fluids.

Figure 3B:
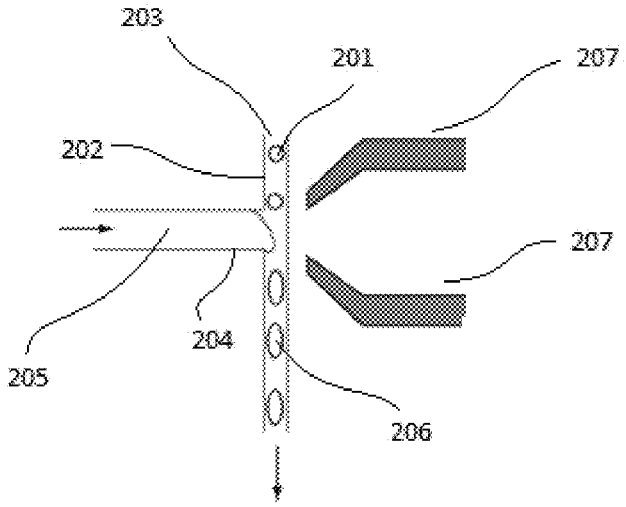
Figure 3C:
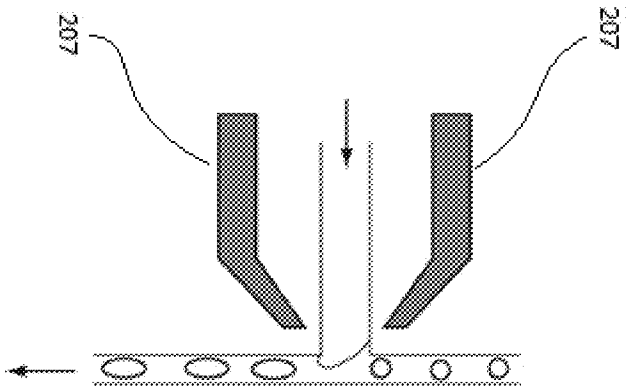
Figure 3D:
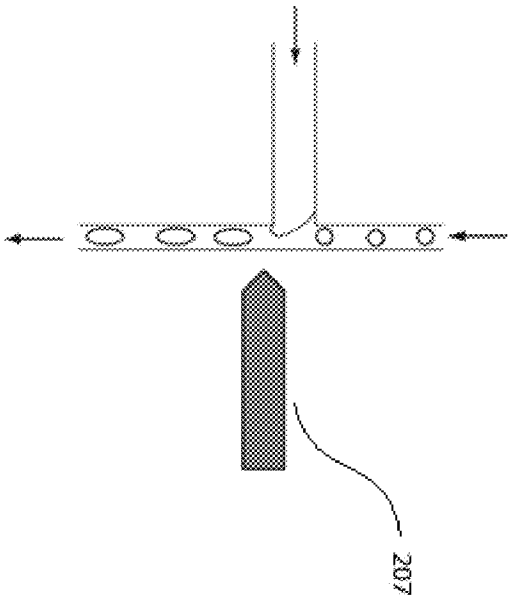
Figure 3E:
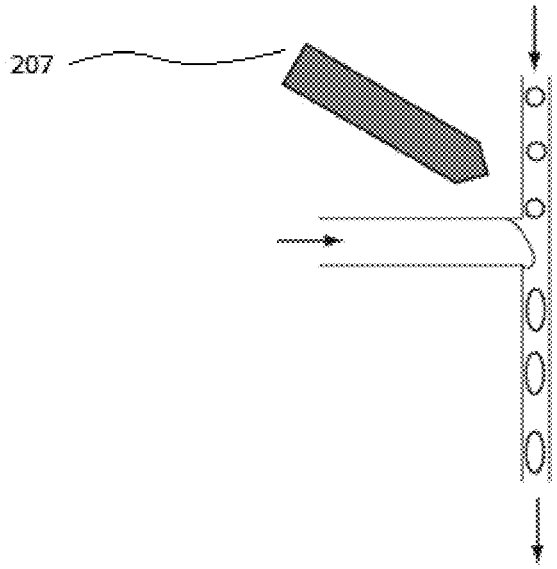
Figure 4:
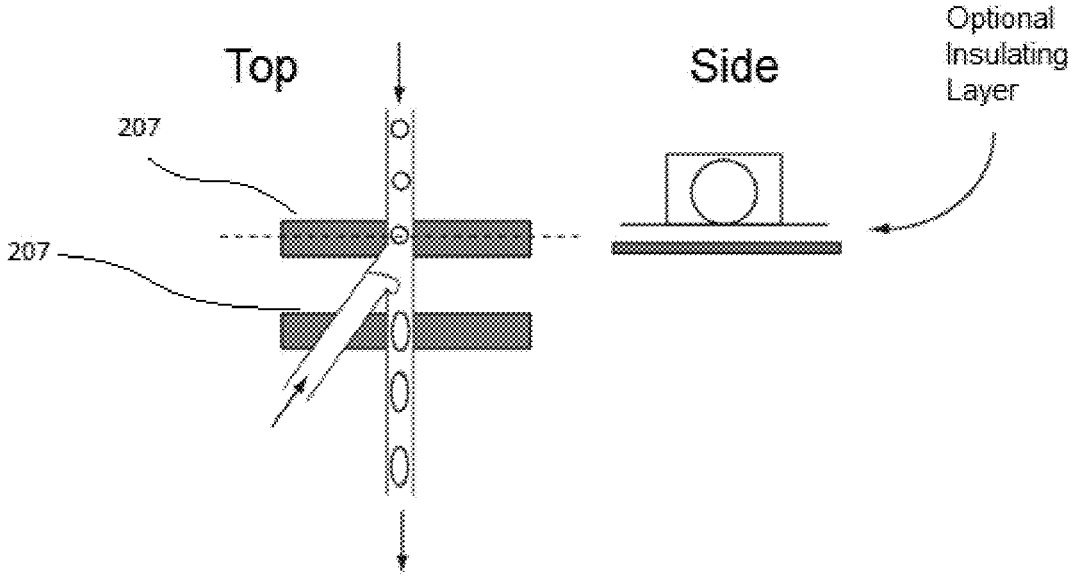
FIG. 4 shows an embodiment in which the electrodes are positioned beneath the channels.

In certain embodiments, an electric charge is applied to the first and second sample fluids (FIGS. 3A-E). Any number of electrodes may be used with methods of the invention in order to apply an electric charge. FIGS. 3A-C show embodiments that use two electrodes 207. FIGS. 3D-E show embodiments that use one electrode 207. The electrodes 207 may positioned in any manner and any orientation as long as they are in proximity to the merge region. In FIGS. 3A-B and D, the electrodes 207 are positioned across from the merge junction. In FIGS. 3C and E, the electrodes 207 are positioned on the same side as the merge junction. In certain embodiments, the electrodes are located below the channels (FIG. 4). In certain embodiments, the electrodes are optionally separated from the channels by an insulating layer (FIG. 4).

Description of applying electric charge to sample fluids is provided in Link et al. (U.S. patent application number 2007/0003442) and European Patent Number EP2004316 to Raindance Technologies Inc, the content of each of which is incorporated by reference herein in its entirety. Electric charge may be created in the first and second sample fluids within the carrier fluid using any suitable technique, for example, by placing the first and second sample fluids within an electric field (which may be AC, DC, etc.), and/or causing a reaction to occur that causes the first and second sample fluids to have an electric charge, for example, a chemical reaction, an ionic reaction, a photocatalyzed reaction, etc.

The electric field, in some embodiments, is generated from an electric field generator, i.e., a device or system able to create an electric field that can be applied to the fluid. The electric field generator may produce an AC field (i.e., one that varies periodically with respect to time, for example, sinusoidally, sawtooth, square, etc.), a DC field (i.e., one that is constant with respect to time), a pulsed field, etc. The electric field generator may be constructed and arranged to create an electric field within a fluid contained within a channel or a microfluidic channel. The electric field generator may be integral to or separate from the fluidic system containing the channel or microfluidic channel, according to some embodiments.

Techniques for producing a suitable electric field (which may be AC, DC, etc.) are known to those of ordinary skill in the art. For example, in one embodiment, an electric field is produced by applying voltage across a pair of electrodes, which may be positioned on or embedded within the fluidic system (for example, within a substrate defining the channel or microfluidic channel), and/or positioned proximate the fluid such that at least a portion of the electric field interacts with the fluid. The electrodes can be fashioned from any suitable electrode material or materials known to those of ordinary skill in the art, including, but not limited to, silver, gold, copper, carbon, platinum, tungsten, tin, cadmium, nickel, indium tin oxide ("ITO"), etc., as well as combinations thereof. In some cases, transparent or substantially transparent electrodes can be used.

The electric field facilitates rupture of the interface separating the second sample fluid 205 and the droplet 201. Rupturing the interface facilitates merging of the bolus of the second sample fluid 205 and the first sample fluid droplet 201 (FIG. 2B). The forming mixed droplet 206 continues to increase in size until it a portion of the second sample fluid 205 breaks free or segments from the second sample fluid stream prior to arrival and merging of the next droplet containing the first sample fluid (FIG. 2C). The segmenting of the portion of the second sample fluid from the second sample fluid stream occurs as soon as the force due to the shear and/or elongational flow that is exerted on the forming mixed droplet 206 by the immiscible carrier fluid overcomes the surface tension whose action is to keep the segmenting portion of the second sample fluid connected with the second sample fluid stream. The now fully formed mixed droplet 206 continues to flow through the first channel 206.

Figure 5:
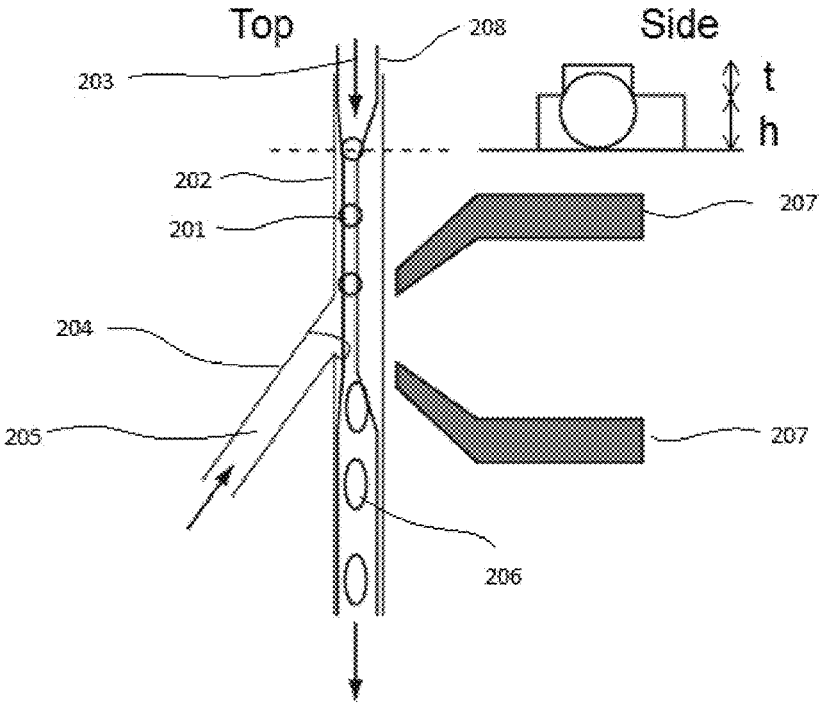
FIG. 5 shows an embodiment of forming a mixed droplet in the presence of electric charge and with use of a droplet track.

FIG. 5 illustrates an embodiment in which a drop track 208 is used in conjunction with electrodes 207 to facilitate merging of a portion of the second fluid 205 with the droplet 201. Under many circumstances it is advantageous for microfluidic channels to have a high aspect ratio defined as the channel width divided by the height. One advantage is that such channels tend to be more resistant against clogging because the "frisbee" shaped debris that would otherwise be required to occlude a wide and shallow channel is a rare occurrence. However, in certain instances, high aspect ratio channels are less preferred because under certain conditions the bolus of liquid 205 emerging from the continuous phase channel into merge may dribble down the side of the merge rather than snapping off into clean uniform merged droplets 206.

An aspect of the invention that ensures that methods of the invention function optimally with high aspect ratio channels is the addition of droplets "tracks" 208 that both guide the droplets toward the emerging bolus 205 within the merger and simultaneously provides a microenvironment more suitable for the snapping mode of droplet generation. A droplet track 208 is a trench in the floor or ceiling of a conventional rectangular microfluidic channel that can be used either to improve the precision of steering droplets within a microfluidic channel and also to steer droplets in directions normally inaccessible by flow alone. The track could also be included in a side wall. FIG. 5 shows a cross-section of a channel with a droplet track 208. The channel height (marked "h") is the distance from the channel floor to the ceiling/bottom of the track 208, and the track height is the distance from the bottom of the track to the channel floor ceiling (marked "t"). Thus the total height within the track is the channel height plus the track height. In a preferred embodiment, the channel height is substantially smaller than the diameter of the droplets contained within the channel, forcing the droplets into a higher energy "squashed" conformation. Such droplets that encounter a droplet track 208 will expand into the track spontaneously, adopting a lower energy conformation with a lower surface area to volume ratio. Once inside a track, extra energy is required to displace the droplet from the track back into the shallower channel. Thus droplets will tend to remain inside tracks along the floor and ceiling of microfluidic channels even as they are dragged along with the carrier fluid in flow. If the direction along the droplet track 208 is not parallel to the direction of flow, then the droplet experiences both a drag force in the direction of flow as well as a component perpendicular to the flow due to surface energy of the droplet within the track. Thus the droplet within a track can displace at an angle relative to the direction of flow which would otherwise be difficult in a conventional rectangular channel.

Figure 6:
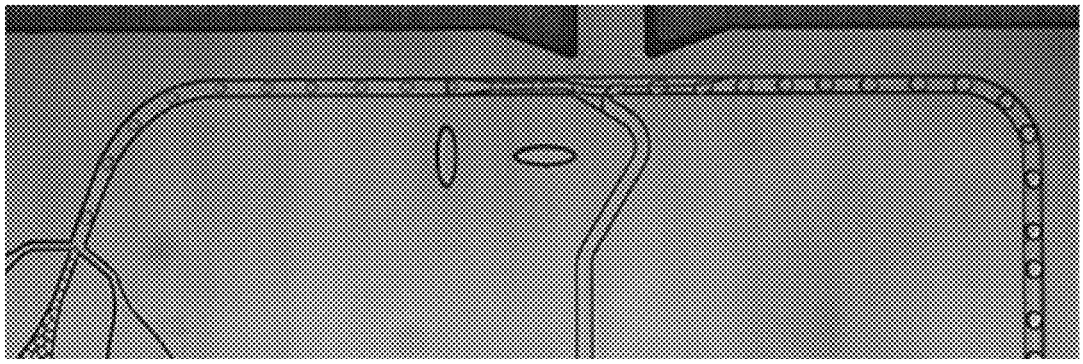
FIG. 6 shows a photograph capturing real-time formation of mixed droplets in the presence of electric charge and with use of a droplet track.
Figure 13A:
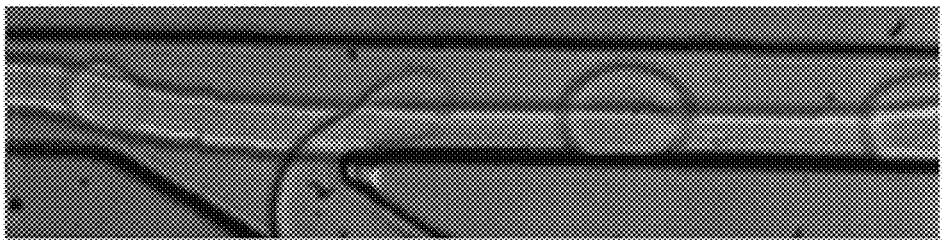
FIGS. 13A-B show a droplet track that was employed with methods of the invention to steer droplets away from the center streamlines and toward the emerging bolus of the second fluid on entering the merge area. These figures show that a mixed droplet was formed without the presence of electric charge and with use of a droplet track.
Figure 13B:
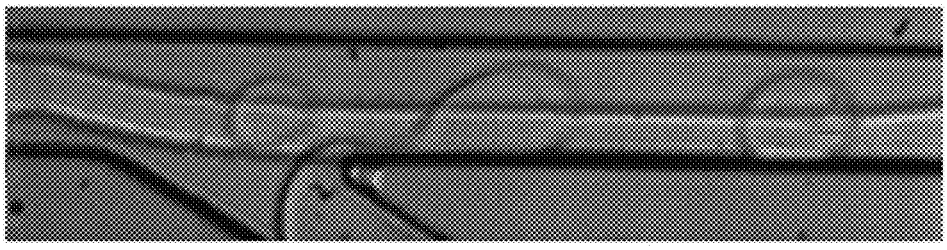

In FIG. 5, droplets 201 of the first sample fluid flow through a first channel 202 separated from each other by immiscible carrier fluid and suspended in the immiscible carrier fluid 203. The droplets 201 enter the droplet track 208 which steers or guides the droplets 201 close to the where the bolus of the second fluid 205 is emerging from the second channel 204. The steered droplets 201 in the droplet track 208 are delivered to the merge area, i.e., junction of the first channel 202 with the second channel 204, by a pressure-driven flow generated by a positive displacement pump. While droplet 201 arrives at the merge area, a bolus of a second sample fluid 205 is protruding from an opening of the second channel 204 into the first channel 202. The bolus of the second sample fluid stream 205 continues to increase in size due to pumping action of a positive displacement pump connected to channel 204, which outputs a steady stream of the second sample fluid 205 into the merge area. The flowing droplet 201 containing the first sample fluid eventually contacts the bolus of the second sample fluid 205 that is protruding into the first channel 202. The contacting happens in the presence of electrodes 207, which provide an electric charge to the merge area, which facilitates the rupturing of the interface separating the fluids. Contact between the two sample fluids in the presence of the electric change results in a portion of the second sample fluid 205 being segmented from the second sample fluid stream and joining with the first sample fluid droplet 201 to form a mixed droplet 206. The now fully formed mixed droplet 206 continues to flow through the droplet trap 208 and through the first channel 203. FIG. 6 shows a droplet track that was employed with methods of the invention to steer droplets away from the center streamlines and toward the emerging bolus of the second fluid on entering the merge area. This figure shows that a mixed droplet was formed in the presence of electric charge and with use of a droplet track. FIGS. 13A-B show a droplet track that was employed with methods of the invention to steer droplets away from the center streamlines and toward the emerging bolus of the second fluid on entering the merge area. These figures show that a mixed droplet was formed without the presence of electric charge and with use of a droplet track.

Figure 7A:
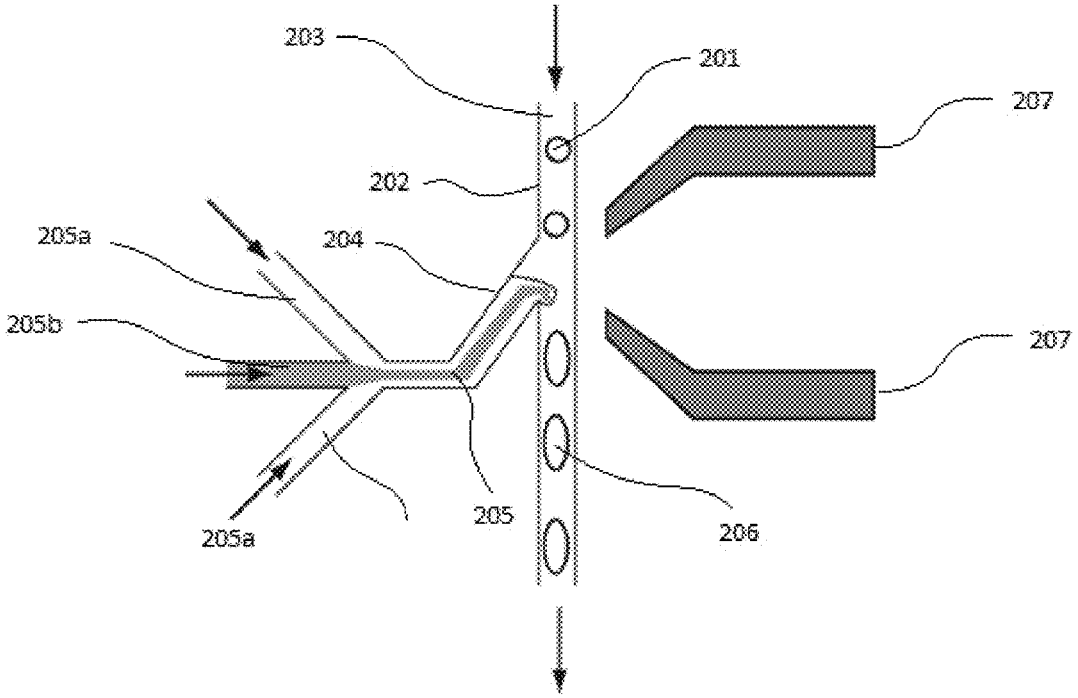
FIGS. 7A-B show an embodiment in which the second sample fluid includes multiple co-flowing streams of different fluids.
Figure 7B:
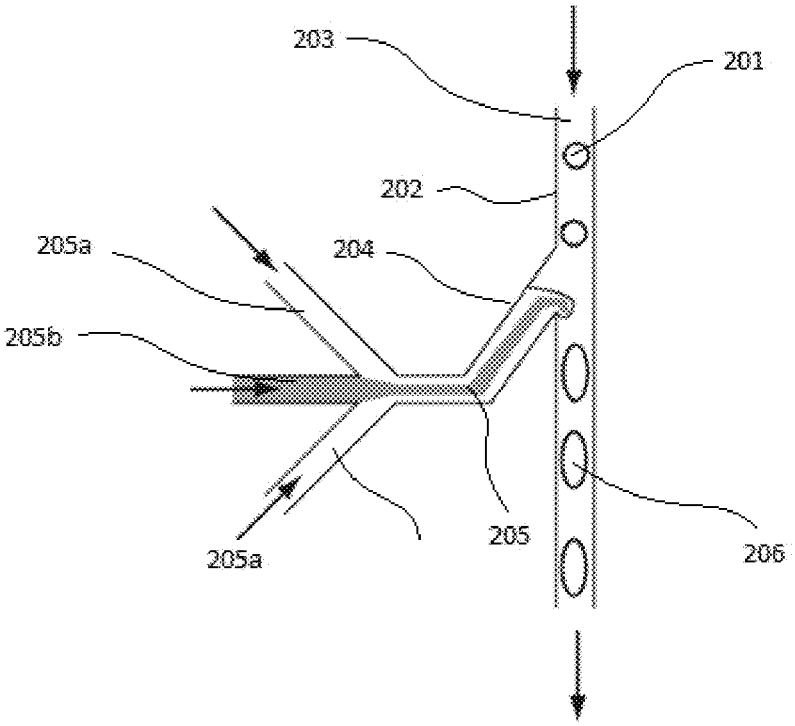

In certain embodiments, the second sample fluid 205 may consist of multiple co-flowing streams of different fluids. Such embodiments are shown in FIGS. 7A-B. FIG. 7A is with electrodes and FIG. 7B is without electrodes. In this embodiments, sample fluid 205 is a mixture of two different sample fluids 205*a* and 205*b*. Samples fluids 205*a* and 205*b* mix upstream in channel 204 and are delivered to the merge area as a mixture. A bolus of the mixture then contacts droplet 201. Contact between the mixture in the presence or absence of the electric change results in a portion of the mixed second sample fluid 205 being segmented from the mixed second sample fluid stream and joining with the first sample fluid droplet 201 to form a mixed droplet 206. The now fully formed mixed droplet 206 continues to flow through the through the first channel 203.

Figure 8:
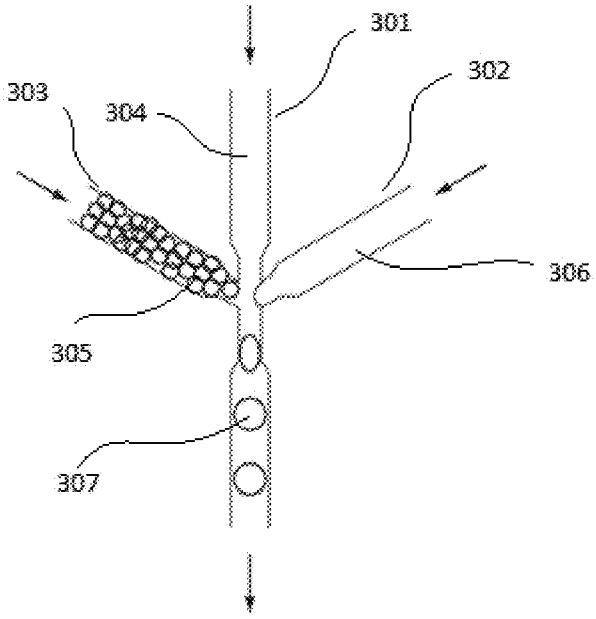
FIG. 8 shows a three channel embodiment for forming mixed droplets. This figure shows an embodiment without the presence of an electric field.
Figure 9:
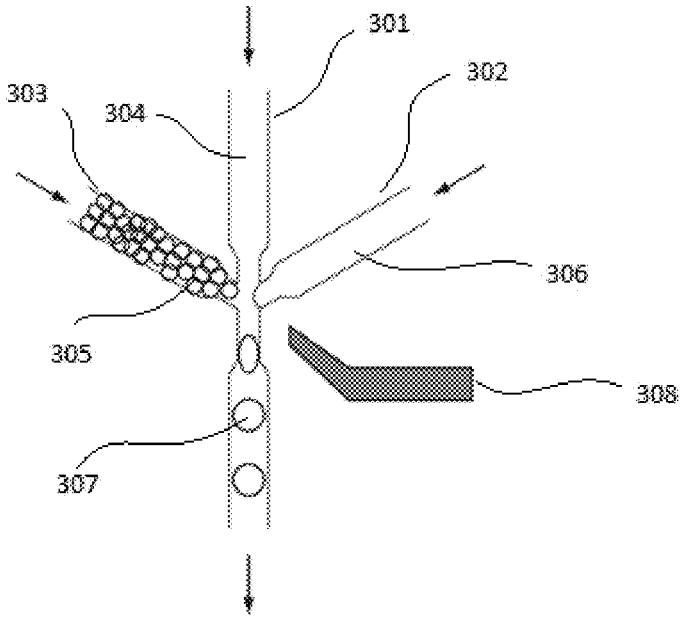
FIG. 9 shows a three channel embodiment for forming mixed droplets.

FIG. 8 shows a three channel embodiment. In this embodiment, channel 301 is flowing immiscible carrier fluid 304. Channels 302 and 303 intersect channel 301. FIG. 8 shows the intersection of channels 301-303 as not being perpendicular, and angle that results in an intersection of the channels 301-303 may be used. In other embodiments, the intersection of channels 301-303 is perpendicular. Channel 302 include a plurality of droplets 305 of a first sample fluid, while channel 303 includes a second sample fluid stream 306. In certain embodiments, a droplet 305 is brought into contact with a bolus of the second sample fluid 306 in channel 301 under conditions that allow the bolus of the second sample fluid 306 to merge with the droplet 305 to form a mixed droplet 307 in channel 301 that is surrounded by carrier fluid 304. In certain embodiments, the merging is in the presence of an electric charge provided by electrode 308 (FIG. 9). In certain embodiments, channel 301 narrows in the regions in proximity to the intersection of channels 301-303. However, such narrowing is not required and the described embodiments can be performed without a narrowing of channel 301.

Figure 10:
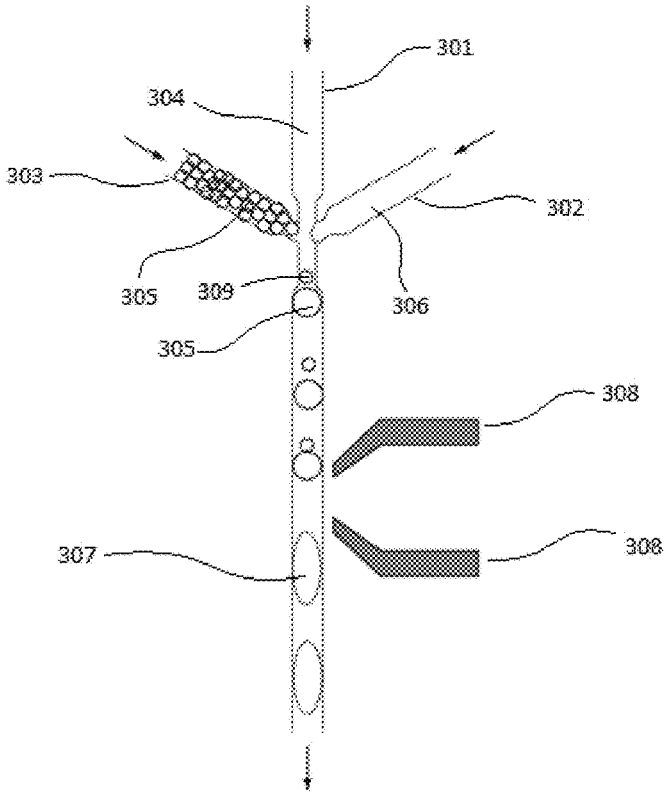
FIG. 10 shows a three channel embodiment for forming mixed droplets. This figure shows a droplet not merging with a bolus of the second sample fluid. Rather, the bolus of the second sample fluid enters the channel as a droplet and merges with a droplet of the first sample fluid at a point past the intersection of the channels.

In certain embodiments, it is desirable to cause the droplet 305 and the bolus of the second sample fluid 306 to enter channel 301 without merging, as shown in FIG. 10. In these embodiments, the bolus of the second sample fluid 306 breaks-off from the second sample fluid stream and forms a droplet 309. Droplet 309 travels in the carrier fluid 304 with droplet 305 that has been introduced to channel 301 from channel 303 until conditions in the channel 301 are adjusted such that droplet 309 is caused to merge with droplet 305. Such a change in conditions can be turbulent flow, change in hydrophobicity, or as shown in FIG. 10, application of an electric charge from an electrode 308 to the fluids in channel 301. Application of the electric charge, causes droplets 309 and 305 to merge and form mixed droplet 307.

Figure 11A:
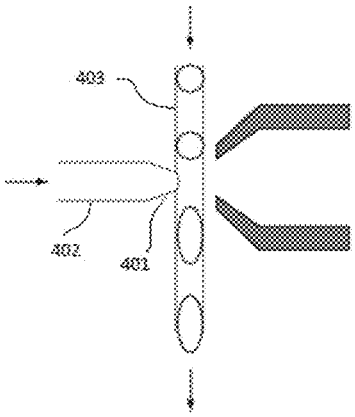
FIGS. 11A-C show embodiments in which the size of the orifice at the merge point for the channel through which the second sample fluid flows may be the smaller, the same size as, or larger than the cross-sectional dimension of the channel through which the immiscible carrier fluid flows.
Figure 11B:
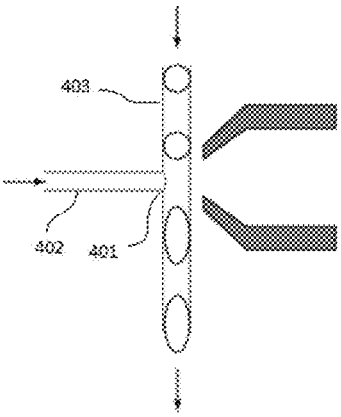
Figure 11C:
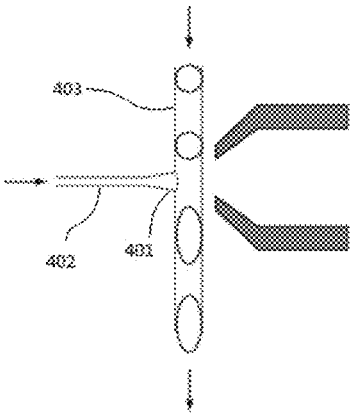

In embodiments of the invention, the size of the orifice at the merge point for the channel through which the second sample fluid flows may be the smaller, the same size as, or larger than the cross-sectional dimension of the channel through which the immiscible carrier fluid flows. FIGS. 11A-C illustrate these embodiments. FIG. 11A shows an embodiment in which the orifice 401 at the merge point for the channel 402 through which the second sample fluid flows is smaller than the cross-sectional dimension of the channel 403 through which the immiscible carrier fluid flows. In these embodiments, the orifices 401 may have areas that are 90% or less than the average cross-sectional dimension of the channel 403. FIG. 11B shows an embodiment in which the orifice 401 at the merge point for the channel 402 through which the second sample fluid flows is the same size as than the cross-sectional dimension of the channel 403 through which the immiscible carrier fluid flows. FIG. 11C shows an embodiment in which the orifice 401 at the merge point for the channel 402 through which the second sample fluid flows is larger than the cross-sectional dimension of the channel 403 through which the immiscible carrier fluid flows.

Methods of the invention may be used for merging sample fluids for conducting any type of chemical reaction or any type of biological assay. In certain embodiments, methods of the invention are used for merging sample fluids for conducting an amplification reaction in a droplet. Amplification refers to production of additional copies of a nucleic acid sequence and is generally carried out using polymerase chain reaction or other technologies well known in the art (e.g., Dieffenbach and Dveksler, PCR Primer, a Laboratory Manual, Cold Spring Harbor Press, Plainview, N.Y. [1995]). The amplification reaction may be any amplification reaction known in the art that amplifies nucleic acid molecules, such as polymerase chain reaction, nested polymerase chain reaction, polymerase chain reaction-single strand conformation polymorphism, ligase chain reaction (Barany F. (1991) PNAS 88:189-193; Barany F. (1991) PCR Methods and Applications 1:5-16), ligase detection reaction (Barany F. (1991) PNAS 88:189-193), strand displacement amplification and restriction fragments length polymorphism, transcription based amplification system, nucleic acid sequence-based amplification, rolling circle amplification, and hyper-branched rolling circle amplification.

In certain embodiments, the amplification reaction is the polymerase chain reaction. Polymerase chain reaction (PCR) refers to methods by K. B. Mullis (U.S. Pat. Nos. 4,683,195 and 4,683,202, hereby incorporated by reference) for increasing concentration of a segment of a target sequence in a mixture of genomic DNA without cloning or purification. The process for amplifying the target sequence includes introducing an excess of oligonucleotide primers to a DNA mixture containing a desired target sequence, followed by a precise sequence of thermal cycling in the presence of a DNA polymerase. The primers are complementary to their respective strands of the double stranded target sequence.

To effect amplification, primers are annealed to their complementary sequence within the target molecule. Following annealing, the primers are extended with a polymerase so as to form a new pair of complementary strands. The steps of denaturation, primer annealing and polymerase extension can be repeated many times (i.e., denaturation, annealing and extension constitute one cycle; there can be numerous cycles) to obtain a high concentration of an amplified segment of a desired target sequence. The length of the amplified segment of the desired target sequence is determined by relative positions of the primers with respect to each other, and therefore, this length is a controllable parameter.

Methods for performing PCR in droplets are shown for example in Link et al. (U.S. patent application numbers 2008/0014589, 2008/0003142, and 2010/0137163), Anderson et al. (U.S. Pat. No. 7,041,481 and which reissued as RE41,780) and European publication number EP2047910 to Raindance Technologies Inc. The content of each of which is incorporated by reference herein in its entirety.

The first sample fluid contains nucleic acid templates. Droplets of the first sample fluid are formed as described above. Those droplets will include the nucleic acid templates. In certain embodiments, the droplets will include only a single nucleic acid template, and thus digital PCR can be conducted. The second sample fluid contains reagents for the PCR reaction. Such reagents generally include Taq polymerase, deoxynucleotides of type A, C, G and T, magnesium chloride, and forward and reverse primers, all suspended within an aqueous buffer. The second fluid also includes detectably labeled probes for detection of the amplified target nucleic acid, the details of which are discussed below. This type of partitioning of the reagents between the two sample fluids is not the only possibility. In certain embodiments, the first sample fluid will include some or all of the reagents necessary for the PCR reaction whereas the second sample fluid will contain the balance of the reagents necessary for the PCR reaction together with the detection probes.

Primers can be prepared by a variety of methods including but not limited to cloning of appropriate sequences and direct chemical synthesis using methods well known in the art (Narang et al., Methods Enzymol., 68:90 (1979); Brown et al., Methods Enzymol., 68:109 (1979)). Primers can also be obtained from commercial sources such as Operon Technologies, Amersham Pharmacia Biotech, Sigma, and Life Technologies. The primers can have an identical melting temperature. The lengths of the primers can be extended or shortened at the 5' end or the 3' end to produce primers with desired melting temperatures. Also, the annealing position of each primer pair can be designed such that the sequence and, length of the primer pairs yield the desired melting temperature. The simplest equation for determining the melting temperature of primers smaller than 25 base pairs is the Wallace Rule ($Td=2(A+T)+4(G+C)$). Computer programs can also be used to design primers, including but not limited to Array Designer Software (Arrayit Inc.), Oligonucleotide Probe Sequence Design Software for Genetic Analysis (Olympus Optical Co.), NetPrimer, and DNAsis from Hitachi Software Engineering. The TM (melting or annealing temperature) of each primer is calculated using software programs such as Oligo Design, available from Invitrogen Corp.

A droplet containing the nucleic acid is then caused to merge with the PCR reagents in the second fluid according to methods of the invention described above, producing a droplet that includes Taq polymerase, deoxynucleotides of type A, C, G and T, magnesium chloride, forward and reverse primers, detectably labeled probes, and the target nucleic acid.

Once mixed droplets have been produced, the droplets are thermal cycled, resulting in amplification of the target nucleic acid in each droplet. In certain embodiments, the droplets are flowed through a channel in a serpentine path between heating and cooling lines to amplify the nucleic acid in the droplet. The width and depth of the channel may be adjusted to set the residence time at each temperature, which can be controlled to anywhere between less than a second and minutes.

In certain embodiments, the three temperature zones are used for the amplification reaction. The three temperature zones are controlled to result in denaturation of double stranded nucleic acid (high temperature zone), annealing of primers (low temperature zones), and amplification of single stranded nucleic acid to produce double stranded nucleic acids (intermediate temperature zones). The temperatures within these zones fall within ranges well known in the art for conducting PCR reactions. See for example, Sambrook et al. (Molecular Cloning, A Laboratory Manual, 3rd edition, Cold Spring Harbor Laboratory Press, Cold Spring Harbor, N.Y., 2001).

In certain embodiments, the three temperature zones are controlled to have temperatures as follows: 95° C. ($T_H$), 55° C. ($T_L$), 72° C. ($T_M$). The prepared sample droplets flow through the channel at a controlled rate. The sample droplets first pass the initial denaturation zone ($T_H$) before thermal cycling. The initial preheat is an extended zone to ensure that nucleic acids within the sample droplet have denatured successfully before thermal cycling. The requirement for a preheat zone and the length of denaturation time required is dependent on the chemistry being used in the reaction. The samples pass into the high temperature zone, of approximately 95° C., where the sample is first separated into single stranded DNA in a process called denaturation. The sample then flows to the low temperature, of approximately 55° C., where the hybridization process takes place, during which the primers anneal to the complementary sequences of the sample. Finally, as the sample flows through the third medium temperature, of approximately 72° C., the polymerase process occurs when the primers are extended along the single strand of DNA with a thermostable enzyme.

The nucleic acids undergo the same thermal cycling and chemical reaction as the droplets pass through each thermal cycle as they flow through the channel. The total number of cycles in the device is easily altered by an extension of thermal zones. The sample undergoes the same thermal cycling and chemical reaction as it passes through N amplification cycles of the complete thermal device.

In other embodiments, the temperature zones are controlled to achieve two individual temperature zones for a PCR reaction. In certain embodiments, the two temperature zones are controlled to have temperatures as follows: 95° C. ($T_H$) and 60° C. ($T_L$). The sample droplet optionally flows through an initial preheat zone before entering thermal cycling. The preheat zone may be important for some chemistry for activation and also to ensure that double stranded nucleic acid in the droplets is fully denatured before the thermal cycling reaction begins. In an exemplary embodiment, the preheat dwell length results in approximately 10 minutes preheat of the droplets at the higher temperature.

The sample droplet continues into the high temperature zone, of approximately 95° C., where the sample is first separated into single stranded DNA in a process called denaturation. The sample then flows through the device to the low temperature zone, of approximately 60° C., where the hybridization process takes place, during which the primers anneal to the complementary sequences of the sample. Finally the polymerase process occurs when the primers are extended along the single strand of DNA with a thermostable enzyme. The sample undergoes the same thermal cycling and chemical reaction as it passes through each thermal cycle of the complete device. The total number of cycles in the device is easily altered by an extension of block length and tubing.

After amplification, droplets may be flowed to a detection module for detection of amplification products. The droplets may be individually analyzed and detected using any methods known in the art, such as detecting for the presence or amount of a reporter. Generally, the detection module is in communication with one or more detection apparatuses. The detection apparatuses can be optical or electrical detectors or combinations thereof. Examples of suitable detection apparatuses include optical waveguides, microscopes, diodes, light stimulating devices, (e.g., lasers), photo multiplier tubes, and processors (e.g., computers and software), and combinations thereof, which cooperate to detect a signal representative of a characteristic, marker, or reporter, and to determine and direct the measurement or the sorting action at a sorting module. Further description of detection modules and methods of detecting amplification products in droplets are shown in Link et al. (U.S. patent application numbers 2008/0014589, 2008/0003142, and 2010/0137163) and European publication number EP2047910 to Raindance Technologies Inc.

In certain embodiments, amplified targets are detected using detectably labeled probes. In particular embodiments, the detectably labeled probes are optically labeled probes, such as fluorescently labeled probes. Examples of fluorescent labels include, but are not limited to, Atto dyes, 4-acetamido-4'-isothiocyanatostilbene-2,2'disulfonic acid; acridine and derivatives: acridine, acridine isothiocyanate; 5-(2'-aminoethyl)aminonaphthalene-1-sulfonic acid (EDANS); 4-amino-N-[3-vinylsulfonyl)phenyl]naphthalimide-3,5 disulfonate; N-(4-anilino-1-naphthyl)maleimide; anthranilamide; BODIPY; Brilliant Yellow; coumarin and derivatives; coumarin, 7-amino-4-methylcoumarin (AMC, Coumarin 120), 7-amino-4-trifluoromethylcouluarin (Coumaran 151); cyanine dyes; cyanosine; 4',6-diaminidino-2-phenylindole (DAPI); 5'5"-dibromopyrogallol-sulfonaphthalein (Bromopyrogallol Red); 7-diethylamino-3-(4'-isothiocyanatophenyl)-4-methylcoumarin; diethylenetriamine pentaacetate; 4,4'-diisothiocyanatodihydro-stilbene-2,2'-disulfonic acid; 4,4'-diisothiocyanatostilbene-2,2'-disulfonic acid; 5-[dimethylamino]naphthalene-1-sulfonyl chloride (DNS, dansylchloride); 4-dimethylaminophenylazophenyl-4'-isothiocyanate (DABITC); eosin and derivatives; eosin, eosin isothiocyanate, erythrosin and derivatives; erythrosin B, erythrosin, isothiocyanate; ethidium; fluorescein and derivatives; 5-carboxyfluorescein (FAM), 5-(4,6-dichlorotriazin-2-yl)aminofluorescein (DTAF), 2',7'-dimethoxy-4'5'-dichloro-6-carboxyfluorescein, fluorescein, fluorescein isothiocyanate, QFITC, (XRITC); fluorescamine; IR144; IR1446; Malachite Green isothiocyanate; 4-methylumbelliferoneortho cresolphthalein; nitrotyrosine; pararosaniline; Phenol Red; B-phycoerythrin; o-phthaldialdehyde; pyrene and derivatives: pyrene, pyrene butyrate, succinimidyl 1-pyrene; butyrate quantum dots; Reactive Red 4 (Cibacron.TM. Brilliant Red 3B-A) rhodamine and derivatives: 6-carboxy-X-rhodamine (ROX), 6-carboxyrhodamine (R6G), lissamine rhodamine B sulfonyl chloride rhodamine (Rhod), rhodamine B, rhodamine 123, rhodamine X isothiocyanate, sulforhodamine B, sulforhodamine 101, sulfonyl chloride derivative of sulforhodamine 101 (Texas Red); N,N,N',N'tetramethyl-6-carboxyrhodamine (TAMRA); tetramethyl rhodamine; tetramethyl rhodamine isothiocyanate (TRITC); riboflavin; rosolic acid; terbium chelate derivatives; Cy3; Cy5; Cy5.5; Cy7; IRD 700; IRD 800; La Jolta Blue; phthalo cyanine; and naphthalo cyanine. Preferred fluorescent labels are cyanine-3 and cyanine-5. Labels other than fluorescent labels are contemplated by the invention, including other optically-detectable labels.

During amplification, fluorescent signal is generated in a TaqMan assay by the enzymatic degradation of the fluorescently labeled probe. The probe contains a dye and quencher that are maintained in close proximity to one another by being attached to the same probe. When in close proximity, the dye is quenched by fluorescence resonance energy transfer to the quencher. Certain probes are designed that hybridize to the wild-type of the target, and other probes are designed that hybridize to a variant of the wild-type of the target. Probes that hybridize to the wild-type of the target have a different fluorophore attached than probes that hybridize to a variant of the wild-type of the target. The probes that hybridize to a variant of the wild-type of the target are designed to specifically hybridize to a region in a PCR product that contains or is suspected to contain a single nucleotide polymorphism or small insertion or deletion.

During the PCR amplification, the amplicon is denatured allowing the probe and PCR primers to hybridize. The PCR primer is extended by Taq polymerase replicating the alternative strand. During the replication process the Taq polymerase encounters the probe which is also hybridized to the same strand and degrades it. This releases the dye and quencher from the probe which are then allowed to move away from each other. This eliminates the FRET between the two, allowing the dye to release its fluorescence. Through each cycle of cycling more fluorescence is released. The amount of fluorescence released depends on the efficiency of the PCR reaction and also the kinetics of the probe hybridization. If there is a single mismatch between the probe and the target sequence the probe will not hybridize as efficiently and thus a fewer number of probes are degraded during each round of PCR and thus less fluorescent signal is generated. This difference in fluorescence per droplet can be detected and counted. The efficiency of hybridization can be affected by such things as probe concentration, probe ratios between competing probes, and the number of mismatches present in the probe.

Methods of the invention may further include sorting the mixed droplets based upon any chosen analytical criterion. A sorting module may be a junction of a channel where the flow of droplets can change direction to enter one or more other channels, e.g., a branch channel, depending on a signal received in connection with a droplet interrogation in the detection module. Typically, a sorting module is monitored and/or under the control of the detection module, and therefore a sorting module may correspond to the detection module. The sorting region is in communication with and is influenced by one or more sorting apparatuses.

A sorting apparatus includes techniques or control systems, e.g., dielectric, electric, electro-osmotic, (micro-) valve, etc. A control system can employ a variety of sorting techniques to change or direct the flow of molecules, cells, small molecules or particles into a predetermined branch channel. A branch channel is a channel that is in communication with a sorting region and a main channel. The main channel can communicate with two or more branch channels at the sorting module or branch point, forming, for example, a T-shape or a Y-shape. Other shapes and channel geometries may be used as desired. Typically, a branch channel receives droplets of interest as detected by the detection module and sorted at the sorting module. A branch channel can have an outlet module and/or terminate with a well or reservoir to allow collection or disposal (collection module or waste module, respectively) of the molecules, cells, small molecules or particles. Alternatively, a branch channel may be in communication with other channels to permit additional sorting.

A characteristic of a fluidic droplet may be sensed and/or determined in some fashion, for example, as described herein (e.g., fluorescence of the fluidic droplet may be determined), and, in response, an electric field may be applied or removed from the fluidic droplet to direct the fluidic droplet to a particular region (e.g. a channel). In certain embodiments, a fluidic droplet is sorted or steered by inducing a dipole in the uncharged fluidic droplet (which may be initially charged or uncharged), and sorting or steering the droplet using an applied electric field. The electric field may be an AC field, a DC field, etc. For example, a channel containing fluidic droplets and carrier fluid, divides into first and second channels at a branch point. Generally, the fluidic droplet is uncharged. After the branch point, a first electrode is positioned near the first channel, and a second electrode is positioned near the second channel. A third electrode is positioned near the branch point of the first and second channels. A dipole is then induced in the fluidic droplet using a combination of the electrodes. The combination of electrodes used determines which channel will receive the flowing droplet. Thus, by applying the proper electric field, the droplets can be directed to either the first or second channel as desired. Further description of droplet sorting is shown for example in Link et al. (U.S. patent application numbers 2008/0014589, 2008/0003142, and 2010/0137163) and European publication number EP2047910 to Raindance Technologies Inc.

Methods of the invention may further involve releasing amplified target molecules or reaction products from the droplets for further analysis. Methods of releasing molecules from the droplets are shown in for example in Link et al. (U.S. patent application numbers 2008/0014589, 2008/0003142, and 2010/0137163) and European publication number EP2047910 to Raindance Technologies Inc.

In certain embodiments, sample droplets are allowed to cream to the top of the carrier fluid. By way of non-limiting example, the carrier fluid can include a perfluorocarbon oil that can have one or more stabilizing surfactants. The droplet rises to the top or separates from the carrier fluid by virtue of the density of the carrier fluid being greater than that of the aqueous phase that makes up the droplet. For example, the perfluorocarbon oil used in one embodiment of the methods of the invention is 1.8, compared to the density of the aqueous phase of the droplet, which is 1.0.

The creamed liquids are then placed onto a second carrier fluid which contains a de-stabilizing surfactant, such as a perfluorinated alcohol (e.g. 1H,1H,2H,2H-Perfluoro-1-octanol). The second carrier fluid can also be a perfluorocarbon oil. Upon mixing, the aqueous droplets begins to coalesce, and coalescence is completed by brief centrifugation at low speed (e.g., 1 minute at 2000 rpm in a microcentrifuge). The coalesced aqueous phase can now be removed and further analyzed.

In certain embodiments, the reaction product is an amplified nucleic acid that is then sequenced. In a particular embodiment, the sequencing is single-molecule sequencing-by-synthesis. Single-molecule sequencing is shown for example in Lapidus et al. (U.S. Pat. No. 7,169,560), Quake et al. (U.S. Pat. No. 6,818,395), Harris (U.S. Pat. No. 7,282,337), Quake et al. (U.S. patent application number 2002/0164629), and Braslaysky, et al., PNAS (USA), 100: 3960-3964 (2003), the contents of each of these references is incorporated by reference herein in its entirety.

Briefly, a single-stranded nucleic acid (e.g., DNA or cDNA) is hybridized to oligonucleotides attached to a surface of a flow cell. The single-stranded nucleic acids may be captured by methods known in the art, such as those shown in Lapidus (U.S. Pat. No. 7,666,593). The oligonucleotides may be covalently attached to the surface or various attachments other than covalent linking as known to those of ordinary skill in the art may be employed. Moreover, the attachment may be indirect, e.g., via the polymerases of the invention directly or indirectly attached to the surface. The surface may be planar or otherwise, and/or may be porous or non-porous, or any other type of surface known to those of ordinary skill to be suitable for attachment. The nucleic acid is then sequenced by imaging the polymerase-mediated addition of fluorescently-labeled nucleotides incorporated into the growing strand surface oligonucleotide, at single molecule resolution.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

The invention may be embodied in other specific forms without departing from the spirit or essential characteristics thereof. The foregoing embodiments are therefore to be considered in all respects illustrative rather than limiting on the invention described herein.

The invention claimed is:

1. A method for forming a mixed droplet, the method comprising:

forming a droplet of a first fluid;

flowing the droplet in a first channel, the first channel comprising a drop track, to steer the droplet toward a junction with a second channel and contacting the droplet at the junction with a bolus of a fluid stream flowing in the second channel to cause a portion of the bolus to segment from the fluid stream and integrate with the droplet to form a mixed droplet, the mixed droplet formed without the presence of electric charge.

2. The method according to claim 1, wherein the fluid stream is delivered via a second channel that is perpendicular to the first channel.

3. The method according to claim 1, wherein the droplet of the first fluid is surrounded by an immiscible carrier fluid.

4. The method according to claim 1, wherein the mixed droplet is surrounded by an immiscible carrier fluid.

5. The method according to claim 3, wherein the immiscible carrier fluid is an oil.

6. The method according to claim 5, wherein the oil comprises a surfactant.

7. The method according to claim 6, wherein the surfactant is a fluorosurfactant.

8. The method of claim 1, further comprising repeating the forming, flowing and contacting steps to form a plurality of mixed droplets from a plurality of droplets of the first fluid, wherein the plurality of droplets of the first fluid are monodisperse.

9. The method of claim 1, wherein the drop track forces the droplet of the first fluid into a higher energy conformation.

10. The method of claim 1, wherein the bolus protrudes into a first stream comprising the droplet of the first fluid.

11. The method of claim 1, wherein the drop track has a channel height smaller than the diameter of the droplet.

12. A method for forming a mixed droplet, the method comprising:

forming a droplet of a first fluid surrounded by an immiscible carrier fluid;

flowing the droplet through a first channel, the first channel comprising a drop track, to steer the droplet toward a junction with a second channel; and contacting the droplet at the junction with a bolus of a fluid stream flowing in the second channel to cause a portion of the bolus to segment from the fluid stream and integrate with the droplet to form a mixed droplet, the mixed droplet formed without the presence of electric charge.

13. The method according to claim 12, wherein the drop track has a channel height smaller than the diameter of the droplet.

14. The method according to claim 12, wherein the first and second channels are perpendicular to each other.

15. The method according to claim 12, wherein the mixed droplet is also surrounded by the immiscible carrier fluid.

16. The method according to claim 12, wherein the immiscible carrier fluid is an oil.

17. The method according to claim 16, wherein the oil comprises a surfactant.

18. The method according to claim 17, wherein the surfactant is a fluorosurfactant.

* * * * *